United States Patent [19]

Lafer

[11] Patent Number: 4,939,802

[45] Date of Patent: Jul. 10, 1990

[54] SOFA-BED

[76] Inventor: Percival Lafer, Rua Garcia Lorca, 301, Sao Bernard do Campo-SP, Brazil

[21] Appl. No.: 292,229

[22] Filed: Dec. 30, 1988

[30] Foreign Application Priority Data

Dec. 30, 1987 [BR] Brazil ..... 8707241

[51] Int. Cl.[5] ..... A47C 17/17

[52] U.S. Cl. ..... 5/37 C; 5/41; 5/42

[58] Field of Search ..... 5/17, 18.2, 18 B, 37 R, 5/37 B, 37 C, 41, 42, 51 B, 51 D, 53 C, 47, 48, 67, 465

[56] References Cited

U.S. PATENT DOCUMENTS

| | | | |
|---|---|---|---|
| 782,335 | 2/1905 | Harvey | 5/67 X |
| 1,090,474 | 3/1914 | Hawley | 5/51 B X |
| 1,180,926 | 4/1916 | Jeffcott | 5/37 C |
| 1,261,040 | 4/1918 | Lanes | 5/67 X |
| 1,903,918 | 4/1933 | Fraser et al. | 5/37 C |
| 2,830,306 | 4/1958 | Wagner et al. | 5/465 |
| 3,002,198 | 10/1961 | Kaiser, Jr. | 5/41 |
| 3,058,126 | 10/1962 | Fleming et al. | 5/465 |
| 4,007,961 | 2/1977 | Costa | 5/18 R X |
| 4,731,888 | 3/1988 | Bridges | 5/37 R |

FOREIGN PATENT DOCUMENTS

| | | | |
|---|---|---|---|
| 1312793 | 11/1962 | France | 5/37 R |

*Primary Examiner*—Michael F. Trettel
*Attorney, Agent, or Firm*—Darby & Darby

[57] ABSTRACT

"SOFA-BED", comprising a basic structure (10) provided with a pair of upper rear supports (13); a back including a rear portion (20) and a front portion (30) articulated to each other, the rear portion (20) having its extreme lower edge articulated to the upper rear supports (13); a seat (40) having its rear edge articulated to the front extreme edge of the front portion of back (30) and having its front edge articulated to a footrest (50), seat (40) being supported on two pairs of rollers (41, 42) so as to be horizontally displaceable between a "sofa" and a "bed" condition, with the back portions and the footrest arranged horizontally and coplanar with seat (40). The rear portion of seat (20) may further assume different raised positions in respect of the horizontal, when the davenport is in the "bed" condition.

23 Claims, 4 Drawing Sheets

SOFA-BED

FIELD OF THE INVENTION

The present disclosure relates to sofa-bed of the type wherein the sofa-bed back is selectively tiltable into a position wherein it defines a bed jointly with the seat.

BACKGROUND OF THE INVENTION

In some of the known sofa-beds of the above mentioned type, it is necessary that the sofa-bed seat/back assembly be manually rotated with respect to the base thererof, until an unlocking mechanism in the back and seat hinge be actuated for the seat/back assembly to become an horizontal surface on which the user may lie in the longitudinal extension of the sofa-bed This type of construction requires a considerable physical exertion from the user in order to configure a bed from a sofa-configuration.

Still in that solution, the crease defined between the back and seat does not allow the surface thereof to be entirely flat after configuring the bed, thereby causing the user, on laying down, to roll towards said crease, which renders the bed thus configured quite inadequate in terms of comfort, also poorly stable by reason of the lateral shifts of the back and the seat in respect of the sofa-bed base.

Besides frequently requiring displacement of the sofa-bed with respect to an adjacent wall before configuring the bed, this known solution requires the sofa-bed length to be equal to that of a bed. Another type of known sofa-bed comprises a hollow sofa structure provided with removable seat and back cushions, the inside of said structure being provided and hinged with a conventional foldable bed. In this solution, the individual sofa and bed structures are heavy, the bed assembly still requires a substantial operational physical effort, plus the fact that, for unfolding and assembly of the bed, it is necessary to remove the sofa-bed back and seat cushions. Finally, in any of the above described solutions, should the user wish to read, write or even watch TV while lying on the bed, it will be necessary to pile up cushions or pillows in order to reach a comfortable position.

SUMMARY OF THE INVENTION

It is an object of the present invention to provide a stable sofa-bed that can be easily operated with little physical exertion. It is another object of the present invention to provide a sofa-bed that allows the configuration of beds of different widths and that need not be displaced from its original position when configuring the bed. It is yet another object of the present invention to provide a sofa-bed that can assume the shapes of a sofa and a bed without the need of removing or rearranging any of its component parts.

It is still another object of the present invention to provide a sofa-bed which, in addition to the two sofa and bed conditions, also presents a third condition allowing the user to raise his head and chest in respect of the horizontal plane, in various positions, without the need of using cushions or pillows, when configured in the bed condition.

It is a further object of the invention to provide a sofa-bed the aesthetic appearance of which is not jeopardized by its constructive characteristics.

These and other objects of the present invention are attained by a sofa-bed comprising: a basic structure supported on the floor and defined by two lateral and parallel portions, rearwardly connected to each other by crossbeams, each of said lateral portions bearing an front upper bracket and a rear upper bracket; a back including a front portion and a rear portion hinged to each other on their upper adjacent edges, the rear portion having its extreme lower edge articulated to the rear upper brackets of the basic structure; a seat having its rear edge articulated to the extreme lower edge of the front portion of the back and its front edge articulating the upper edge of a footrest, the seat being supported over two pairs of rollers so as to be horizontally displaceable between a "sofa" condition, with the rollers positioned between the lateral portions of the basic structure and the front and rear portions of the back maintained in an upright position, and a "bed" condition with the rollers displaced to the front of the basic structure and the the front and rear portions of the back and the footrest coplanar to the seat portion, raising the footrest to the horizontal position being done by a long rigid stem having its front end articulated under the footrest and its rear end articulated to an extension of the front portion of the back that projects downwards from the articulation point thereof with the back, said back and seat portions and the footrest being covered with a layer of flexible material.

An additional aspect of the present invention results from the fact that, in the "sofa" condition, the articulation between both back portions is displaced rearwards in respect of the articulation of the rear back portion with the upper rear brackets of the basic structure and the basic structure and the pair of rear casters being slightly raised from the ground, the seat assuming a position slightly tilted rearwards and supported frontwise on the pair of front rollers and rearwise on its articulation with the lower edge of the rear portion of the back. That arrangement causes the back to be displaced rearward, becoming stable in that sofa condition without the need of special locks, but merely employing a small abutment for the two portions of the back or between either of them and the basic structure.

A further aspect of the invention lies in the fact that the pair of front rollers is assembled on supports articulated on their upper portion to the seat and articulated in their middle to the rigid stem that drives the footrest or directly to the latter, so that the axis of said pair of rollers is displaced from a rear position to a front position in respect of the articulation of the seat supports when the latter is displaced from the "sofa" position to the "bed" position, assuming a horizontal position.

Still another aspect of the invention results from the fact that the lining covering the furniture parts is provided with cross creases in the articulation regions between the seat and the footrest and between the front and rear positions of the back, said lining showing a gap in the region of articulation between the seat and the front position of the back. The movement of the sofa-bed from an operational condition into another can be done by application of a small manual force in the articulation region between the front and rear portions of the back or through a mechanical device, preferably in the shape of a pedal which, when actuated by levers, applies a torsion moment to the articulation stem of the rear portion of the back to the basic structure, causing the displacement of the movable portions of the assembly, from one of the operational conditions to the other. According to another particular aspect of the invention, the rear portion of the back comprises a lower chassis articulated to the basic structure and to the front portion of the seat, and an upper plate supporting the lining, articulated in the front to the front region of the chassis and supported on its rear thereon in different angular positions from 0 through about 60° with respect to the horizontal, defining a third operational condition of the assembly, viz, a bed in the "reading" position.

BRIEF DESCRIPTION OF THE DRAWING

The present invention will be described hereinbelow with reference to the appended drawings, wherein.

DESCRIPTION OF THE PREFERRED EMBODIMENTS

Figure 2:
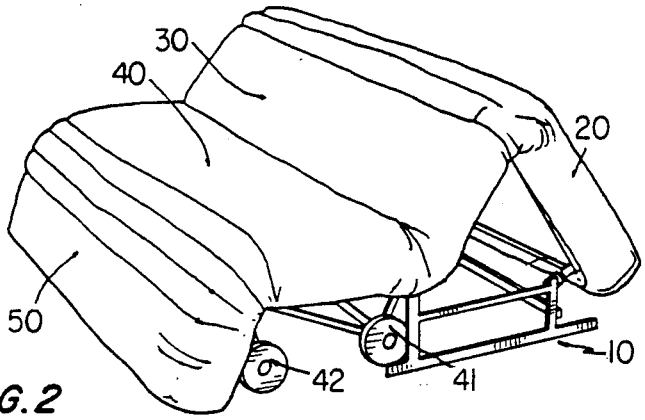
FIG. 2 represents a similar view as FIG. 1, but illustrating the sofa in an intermediate position during its configuration into a "bed".

In accordance with said illustrations, the sofa-bed in question comprises initially a basic structure 10 defined by two side beans 11 supported on the floor, parallel to each other and each incorporating a front upper stem 12 and a rear upper stem 13. The two lateral beams 11 are interconnected to each other by means of a cross beam (FIG. 2) with their ends attached between the two rear upper stems 13, the front stem 12 and rear stem 13 of each beam 11 being connected on the upper side by an upper bracing 15.

On the upper end of each rear upper stem 13 is articulated a small rigid arm 21 rigidly attached under a rear portion of back 20, which, in the "sofa" condition, remains arranged in an upright position, having its upper extreme edge articulated to the upper extreme edge of a front portion of back 30 which extends rampwise downwards and towards the front, until it meets the rear edge of seat 40 with which it is articulated. The front portion of back 30 incorporates an extreme rear projection 31 which projects downwards from the articulation point between said front portion of back and the rear edge of seat 40.

In the illustrated configuration, the bracings 15 support on the upper side a bracket 16 against which is supported the extreme rear projection 31 of the front portion of back 30 when the furniture level is in the "sofa" condition. As can be observed, in that "sofa" condition, the articulation axis X between the two portions of back 20 and 30 is displaced rearwards in respect of the articulation axis Y between the rear portion of back 20 and the rear upper projections 13 of the basic structure 10, causing any downward force applied on the Z articulation axis between the seat and the front portion of back 30 to force that front portion of back 30 against the rear portion of back 20, that is, forcing the extreme rear projection 31 against the bracket 16 of the basic structure 10, maintaining the two portions of back in a stable equilibrium condition when the furniture is in the "sofa" condition.

Seat 40 carries on the lower part thereof a pair or rear rollers 41 attached to vertical stems **41*a* maintained in a fixed position during all operations of the furniture in question and a pair of front rollers 42 attached under the seat by stems 42*a* articulated on the upper side under the seat. The two pairs of rollers 41 and 42 present a cross shaft 43 which maintains the rollers of each pair away from each other, since the attachment of the stems 41*a* and 42*a* under seat 40 is done so as to allow, upon removal of the two shafts 43, that the rollers 41 and 42 be hingedly folded back inwards, against the lower face of the seat, and the footrest, respectively, so as to facilitate the packaging of the assembly for transportation. It should be observed that the stems 41*a* supporting the rear rollers 41 are attached on the lower portion to a lateral stem 44 the upper end of which is attached under seat 40, the upper end of stems 42*a* being articulated to the upper portion of the respective lateral stem 44. In addition, the stems 41*a* and side stem 44 are hingedly attached under seat 40 around axes parallel to the furniture depth, thereby allowing said rollers to be folded inwards. The manner whereby stems 41*a* and 44** are attached under the seat is not illustrated on the drawings; it should be illustrated that various attachment systems can be used, as long as they allow said folding of the rollers at the time of packaging the assembly for transportation.

In order to facilitate further the packaging of the assembly, the two side beams of the basic structure 10 can have the end or arm 21 articulated to the rear portion of seat 20 so that, upon removal of crossbeam 14, the two portions of the basic structure 10 be folded against the lower face of the rear portion of back 20 when the furniture is in the "bed" condition.

In the illustrated configuration, seat 40 comprises a peripheral, rectangular, metallic frame supporting a piece of canvas or similar material occupying its entire front and median area, the rear edge of this canvas element 45 being attached to the rear seat edge by means of a plurality of spring elements 46. This construction provides the seat 40 with the necessary flexibility required for a sofa seat. In order to prevent deformation of seat 40 when submitted to normal loads, a longitudinal curved stem 47 is provided, with a rear end articulated to the rear edge of the seat and having the front end articulated to the front edge of the seat so that, when a vertical load is applied on the seat, the two front and rear opposed edges of said peripheral frame will force by means of their slight elastic deformation the curved stem or bar 47 into a position arranged entirely in a vertical plane, whereupon it operates as a stop to prevent an excessive deformation of said peripheral frame of seat 40. That curved stem or bar 47 is automatically brought into a position arranged in a plane substantially parallel to seat 40 when a vertical, downwards load is no longer applied on the latter.

Figure 3:
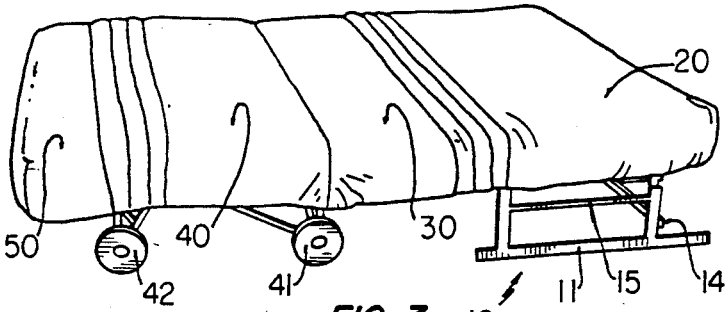
FIG. 3 represents a perspective view of the furniture in question in the "bed" condition.
Figure 4:
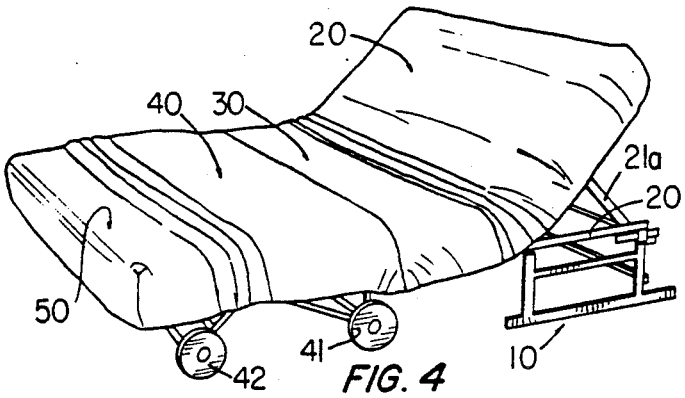
FIG. 4 represents a perspective view of the bed of FIG. 3 with the rear portion of the back raised into a 37 reading" position.
Figure 6:
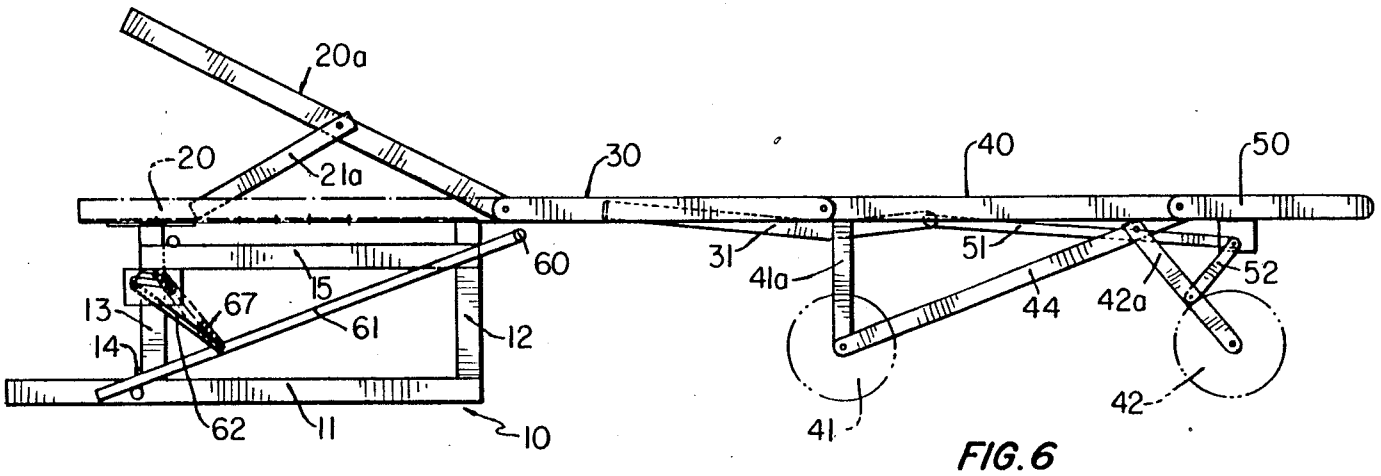
FIG. 6 illustrates a lateral view of the assembly of the previous figure in the "bed" condition, with the rear portion of the back raised into a reading position.
Figure 7:
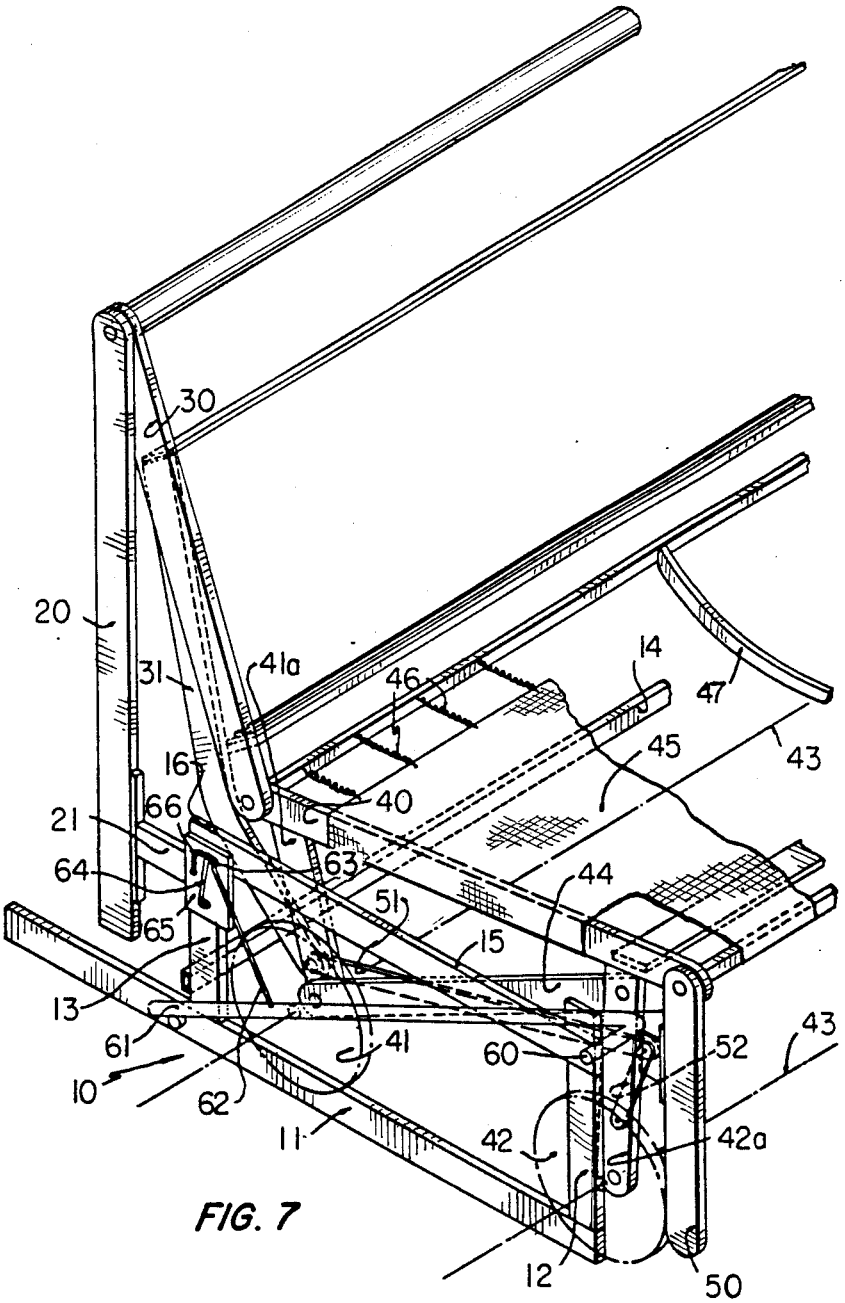
FIG. 7 illustrates a front, simplified perspective view of the sofa-bed in the "sofa" condition and without the flexible cover lining.

On the front edge of seat 40 is articulated a footrest 50 having a rectangular contour and having the middle portion of its lateral edges interconnected to the lower end of the respective rear projection 31 of the front portion of back 30, through a rigid, elongated stem 51, the attachment of the ends of that stem being made in an articulated manner so that, upon movement of said rear projections 31, the footrest 50 is brought into its collapsed position in the sofa condition and folded upwards until it reaches a horizontal position in the "bed" condition, such as illustrated on FIGS. 3, 4 and 6. Each end of the two rigid stems 51 is further articulated to the middle portion of stems 42*a* that support the front rollers 42, by means of a small articulation arm 52.

Figure 1:
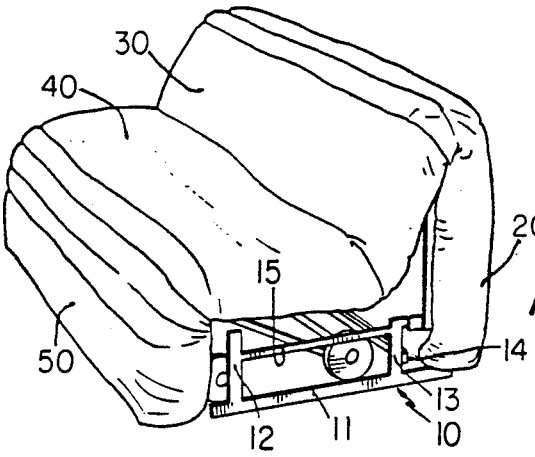
FIG. 1 represents a perspective view of the sofa-bed in question in the "sofa" condition and without the lateral finish for a better observation of its construction.

In the illustrated configuration, the articulation point of the rigid stems 51 and the front roller stems 42*a* under the footrest 50 is designed so as to allow the rollers to be folded inwards, against the lower face of the seat and the footrest. With the construction in question, in the "sofa" condition, the pair of rear rollers 41 remains slightly away from the floor, so that the entire load applied on seat 40 is distributed between the pair of front rollers 42 and the portions of back 30 and 20 In that manner, the furniture in question will remain stable in the "sofa" condition, independently, of the load applied thereon, since the weight of the structure itself, jointly with the relative positioning between the axes X and Y, is sufficient to lock the structure of the assembly in the condition illustrated on FIGS. 1 and 5 by action of the abutment 16 against the rear projection 31 of the front abutment portion 30.

In order to move said davenport into the "bed" condition, it is merely necessary to apply a small forward force over the articulation region of the two portions of back 20 and 30, causing seat 40 to be horizontally displaced forward, initially supported on the front rollers 42 and subsequently also on the rear rollers 41 after the articulation axis has passed at a certain angle forward of the alignment of articulation axis Y. It should be observed that in the "sofa" condition, even when rollers 41 are slightly away from the floor, seat 40 remains slightly tilted down and rearwards and, as the assembly is displaced forward, the rear rollers 41 start touching the floor, while the lower projections 31 of the front abutment portion 30 are urging the respective elongated rigid stems 51 forward, tilting the footrest 50 upwards, also pulling the front stems 42*a* of the front rollers 42 forward by means of the small articulation arms 52, causing the rollers 42 to have their axis 43 displaced forward in respect of the articulation point between its support stems 42*a* and the front region of seat 40. Upon this displacement of rollers 42, the rear rollers will have their common axis 43 located at a level exactly equal to that of the axis of front rollers 42, causing seat 40 to occupy a horizontal position co-planar with footrest 50.

As can be observed from FIGS. 3 and 6, in the "bed" condition the two portions of back 20 and 30, seat 40 and footrest 50 occupy the same horizontal, co-planar arrangement, defining a support surface for a flexible lining that defines a mattress arranged thereon. In that "bed" condition, the articulation region between the two portions of the back is laterally supported on the two front upper projections 12 of the basic structure 10, ensuring a perfect stability for the assembly. It should also be noted that the displacement of the pair of front rollers 42 forward, in addition to equalizing the height of the seat and footrest components, transfers the front support point of the "bed" forward, preventing the application of a vertical load on the horizontal footrest from unbalancing the assembly, such as happens with the lateral, cantilevered portions in some of the solutions of the prior art.

As can be observed on FIGS. 3 and 6, on the two back portions 20 and 30 is attached a flexible lining or upholstery portion 80, preferably foam, entirely covering the upper face of said portions and provided on the articulation region thereof, with a plurality of cross creases 81 occupying the entire width of the cushion, dimensioned so as to remain open when the two abutment portions are in the sofa condition and to become entirely closed when the two abutment portions are angularly displaced into the horizontal, coplanar "bed" condition. An identical situation occurs with seat 40 and footrest 50 which are also lined on the upper part thereof with a single flexible lining or cushion 90 provided with the same cross creases 91 in the articulation region between these two component parts of the assembly. This arrangement of two single, fixed cushions allows the furniture to be converted into a sofa or a bed without the need of displacing or manipulating either of them.

In the "bed" condition, the two upholstery portions 80 and 90 have their front bach and seat portions displaced one towards the other by the closing action of creases 81 and 91, allowing the elimination of a gap in the connecting region between the seat and the back.

The two upholstery portions 80 and 90 are still interconnected by a cloth ribbon 85.

Even considering the ease of modifying the operational condition of said furniture, it can also be provided with a device allowing one to change the furniture condition by means of a single touch on a pedal or lever.

Figure 5:
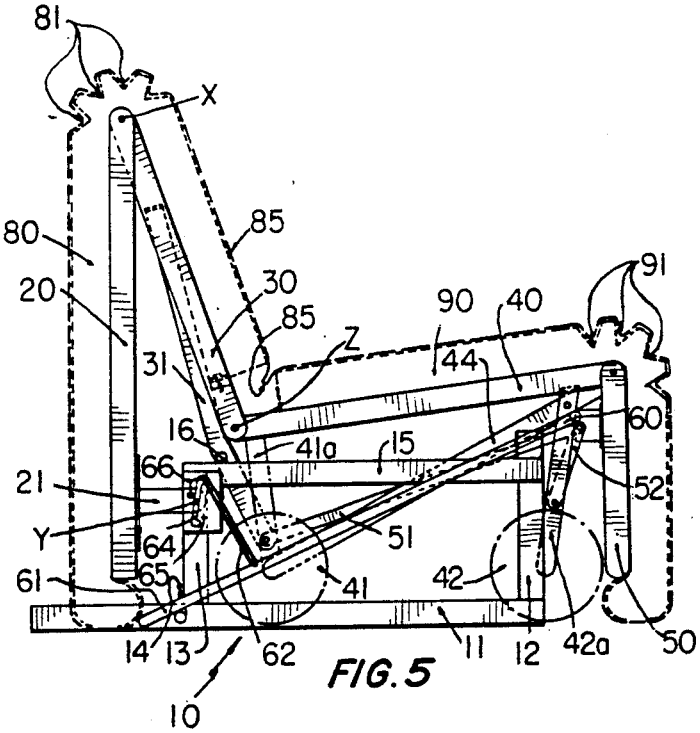
FIG. 5 represents a lateral view of the sofa-bed in the "sofa" condition and with the flexible lining illustrated in phantom lines.

In the configuration illustrated on FIGS. 5 and 6, said device comprises a pedal 60 assembled on the upper end of a tilted lever 61 having its lower end articulated near the rear portion of one of beams 11 of the basic structure, said lever articulating in its middle portion a stem 62 extending upward and having its upper end incorporating a pin 63 displaceable inside a groove 64 in the approximate "C" shape made on a plate 65 incorporated in the extension of articulation stem or arm 21 of the rear portion of back 20. Plate 65 is located forward of articulation axis Y between the basic structure 10 and the rear portion of back 20, in the "sofa" condition the pin 63 of stem 62 being located in the upper end of groove 64, as illustrated on FIG. 5. Pin 63 is continuously urged by a leaf spring 66 towards the end of groove 64 lying above axis Y, lever 61 being also connected in the middle portion thereof to the upper rear projection 13 by means of a return spring 67. With this arrangement, when the assembly is in the sofa condition, with pin 63 housed in the upper end of the "C"-shaped groove 64, when lever 61 is pressed down by application of a force on pedal 60, the stem 62 will pull plate 65 downwards, causing a momentum on the plate-arm assembly 21 which will then turn around the articulation axis Y until the component parts of the furniture reach the horizontal position in the "bed" condition. In that condition, as illustrated on FIG. 6, the "C"-shaped groove occupies a downward facing positioning, with its middle portion arranged substantially horizontally. Upon release of the pressure on pedal 60, lever 61 will be again pressed upwards by action of return spring 67, causing pin 63 to be displaced towards the other, opposite end of groove 64 which will be then located behind the articulation axis Y between the back and the basic structure. The fitting of pin 63 in the opposite or lower end of the "C"-shaped groove in the bed condition is aided by leaf spring 66. When pin 63 is already fitted to the lower end of groove 64, pressing or displacing lever 61 downwards will cause a momentum in the opposite direction on the plate 65 and stem 21 assembly, causing the rear abutment portion 20 to be rotated around said articulation axis so as to return to the vertical, "sofa" position. During that displacement, the front portion of this front abutment portion will pull the front portion of the back and consequently seat 40 rearward, back to the "sofa" position, the movement of the front portion of back 30 causes by means of rigid elongated stems 51 the return of footrest 50 and front casters 42 to the retracted, "sofa" position, as illustrated on FIG. 5.

The front portion of back 20 further includes a flat plate 20*a* (FIG. 6) having its front edge horizontally articulated near the front edge of said rear portion of back 20 and provided with a pair of middle, lateral stems 21*a* the lower ends of which are fitted in housings (not illustrated) provided on the sides of the rear portion of back 20, so as to allow plate 20*a* to be raised with respect to the horizontal, reaching different "reading" positions when the davenport is in the "bed" condition.

I claim:

1. A SOFA-BED comprising a basic structure (10) defined by two lateral, parallel portions (11, 15) rearwardly interconnected to each other by means of a removable crossbeam (14); a back including a front portion (30) and a rear portion (20) articulated to each other by means of a pair of adjacent upper edges, the rear portion (20) having a lower extreme edge articulate to the structure (10); a seat (40) having a rear edge articulated to a lower extreme edge of the front back portion (30), and having a front edge articulated to an upper edge of a footrest (50), the seat (40) being supported on a pair of rear rollers (41) and a pair of front rollers (42) so as to be horizontally displaceable between a "sofa" condition, with the rollers (41, 42) positioned between the lateral portions of the basic structure (10) and the front (30) and rear (20) portions of the back maintained in a raised position, and a "bed" condition, with the rollers displaced forward of the basic structure (10) and with the front and rear back portions and the footrest (50) arranged horizontally coplanar with the seat portion (40), the pair of front rollers (42) being assembled on front stems (42*a*) articulated by an upper portion thereof to the seat (40) and also articulated in a middle portion thereof to the footrest (50) by means of a small stem (52) so as to be displaced between a rear position an a front position by an articulation of said front stems (42*a*) to seat (40) when the latter is displaced between the "sofa" condition and the "bed" condition, said seat occupying a horizontal position in the "bed" condition and being supported on the floor by means of the two pairs of rollers (41, 42), being raised the footrest (50) into the horizontal position by a long, rigid stem (51) having a front end articulated to the footrest (50) and a rear end articulated to an extension (31) of the front portion of the back (30) that projects downwards from the articulation axis of that back portion with seat (40), said back portions, the seat and the footrest being lined with a layer of flexible material (80, 90).

2. SOFA-BED in accordance with claim 1, wherein the articulation region between the rear (20) and front (30) portions of the back is supported on upper front brackets (12) of the basic structure (10) when the davenport assumes the "bed" condition.

3. SOFA-BED in accordance with claim 1, wherein the articulation axis between the two back portions is located, in the "sofa" condition, displaced backward in relation to the articulation axis between the rear portion of back (20) and the basic structure, with the pair of rear rollers (41) being slightly raised from the floor the front back portion being supported against abutment beams (16) connected to the basic structure (10).

4. SOFA-BED in accordance with claim 3, wherein in the "sofa" condition, the seat (40) assumes a position slightly tilted down and back.

5. SOFA-BED in accordance with claim 1, wherein said front stems (42*a*) (42) are articulated on the upper portion thereof to an upper portion of respective lateral rigid stems (44), interconnecting the center of each rear roller (41) to the front edge of the seat (40).

6. SOFA-BED in accordance with claim 5, wherein each pair of rollers (41, 42) is provided with a removable cross shaft (43), each rear roller (41) being supported by a rear stem (41a) attached by an upper portion thereof to the seat (40).

7. SOFA-BED in accordance with claim 6, wherein the rear stems (41*a*), the lateral stems (44) and the small stems (52) are articulated on the upper portions thereof to the seat and the footrest, respectively, so as to allow the folding thereof, jointly with the rollers, against a lower face of the seat and the footrest upon removal of shafts (43), the davenport being in "bed" condition.

8. SOFA-BED in accordance with claim 1, wherein the seat (40) comprises a metallic rectangular frame supporting a cloth deck (45) in its middle and front regions, the rear portion of said deck (45) being attached to the rear edge of the frame by means of a plurality of spring elements (46), the front and rear edges of seat (40) being interconnected by at least a lower curved stem (47) having its ends attached to said seat edges (40).

9. SOFA-BED in accordance with claim 1, wherein the layer of flexible material comprises two upholstery portions (80, 90) presenting a plurality of cross creases (81, 91) in the articulation regions between the two back portions (20, 30) and between the sear (40) and the footrest (50), the upholstery portions (80, 90) being arranged on the front portion of the back (30) and on the seat (40) so as to be displaced toward each other by a closing action of the cross creases (81, 91) when the davenport is driven into the "bed" condition.

10. SOFA-BED comprising a basic structure (10) defined by two lateral, parallel portions (11, 15) rearwardly interconnected to each other by means of a removably crossbeam (14); a back including a front portion (3) and a rear portion (20) articulated to each other by means of a pair of adjacent upper edges, the rear portion (20) having a lower extreme edge articulated to the structure (10); a seat (40) having a rear edge articulated to a lower extreme edge of the front back portion (30), and having a front edge articulated to an upper edge of a footrest (50), the seat (40) being supported on two pairs of rollers (41, 42) so as to be horizontally displaceable between a "sofa" condition, with the rollers (41, 42) positioned between the lateral portions of the basic structure (10) and the front (30) and rear (20) portions of the back maintained in a raised position and a "bed" condition, with the rollers displaced forward of the basic structure (10) and with the front and rear back portions and the footrest (50) arranged horizontally coplanar with the seat portion (40), the footrest (50) being raised into the horizontal position by a long, rigid stem (51) having a front end articulated to the footrest (50) and a rear end articulated to an extension (31) of the front portion of the back (30) that projects downwards from the articulation axis of that back portion with seat (40), said back portions, the seat and the footrest being lined with a layer of flexible material (80, 90), the articulation between the rear portion of the back (20) and the basic structure (10) being done by means of small rigid arms (21) orthogonally attached to said rear portion of the back and which are articulated so as to allow the folding of the lateral portions of the basic structure (10) against a lower face of the rear portion of the back (20) upon removal of the crossbeam (14), with the sofa-bed being in the "bed" condition.

11. SOFA-BED in accordance with claim 10, wherein the articulation region between the rear (20) and the front (30) portions of the back si supported on upper front brackets (12) of the basic structure (10) when the sofa-bed assumes the "bed" condition.

12. SOFA-BED in accordance with claim 10, wherein the articulation axis between the two back portions is located, in the "sofa" condition, displaced backward in relation to the articulation axis between the rear portion of back (20) and the basic structure, with the pair of rear rollers (41) being slightly raised from the floor the front back portion being supported against abutment means (16) connected to the basic structure (10).

13. SOFA-BED in accordance with claim 12, wherein in the "sofa" condition, the seat (40) assumes a position slightly tilted down and back.

14. SOFA-BED in accordance with claim 10, wherein the seat (40) comprises a metallic rectangular frame supporting a cloth deck (45) in its middle and front regions, the rear portion of said deck (45) being attached to the rear edge of the frame by means of a plurality of spring elements (46), the front and rear edges of seat (40) being interconnected by at least a lower curved stem (47) having its ends attached to said seat edges (40).

15. SOFA-BED in accordance with claim 10, wherein the layer of flexible material comprises two upholstery portions (80, 90) presenting a plurality of cross creases (81, 91) in the articulation regions between the two back portions (20, 30) and between the seat (40) and the footrest (50), the upholstery portions (80, 90) being arranged on the front portion of the back (30) and on the seat (40) so as to be displaced toward each other by a closing action of the cross creases (81, 91) when the davenport is driven into the "bed" condition.

16. SOFA-BED comprising basic structure (10) defined by two lateral, parallel portions (11, 15) rearwardly interconnected to each other by means of a removable crossbeam (14); a back including a front portion (30) and a rear portion (20) articulated to each other by means of a pair of adjacent upper edges, the rear portion (20) having its extreme edge articulated to the structure (10); a seat (40) having its rear edge articulated to a lower extreme edge of the front back portion (30), and having its front edge articulated to an upper edge of a footrest (50), the seat (40) being supported on two pairs of rollers (41, 42) so as to be horizontally displaceable between a "sofa" condition, with the rollers (41, 42) positioned between the lateral portions of the basic structure (10) and the front (30) and rear (20) portions of the back maintained in a raised position, and a "bed" condition, with the rollers displaced forward of the basic structure (10) and with the front and rear back portions and the footrest (50) arranged horizontally coplanar with the seat portion (40), the footrest (50) being raised into the horizontal position by a long, rigid stem (51) having a front end articulated to the footrest (50) and a rear end articulated to an extension (31) of the front portion of the back (30) that projects downwards from the articulation axis of that back portion with seat (40), said back portions, the seat and the footrest being lined with a layer of flexible material (80, 90), the sofa-bed also including a drive device comprising a pedal (60) coupled to an end of a lever the other end of which is articulated to one of the lateral portions of the basic structure (10), said lever articulated at middle portion thereof, the end of a stem (62), the stem having an other end coupled to a plate (65) incorporated to a small arm (21) attached to the rear portion of the back (20), said coupling being done so that a downward displacement of the lever (61) causes by means of the stem (62) the rotation of the small arm (21), such that the sofa-bed converts the "sofa" position to the "bed" position.

17. SOFA-BED in accordance with claim 10, wherein the articulation region between the rear (20) and front (30) portions of the back is supported on upper front brackets (12) of the basic structure (10) when the sofa-bed assumes the "bed" condition.

18. SOFA-BED in accordance with claim 16, wherein the articulation axis between the two back portions is located, in the "sofa" condition, displaced backward in relation to the articulation axis between the rear portion of back (20) and the basic structure, the with pair of rear rollers (41) being slightly raised from the floor the front back portion being supported against abutment means (16) connected to the basic structure (10).

19. SOFA-BED in accordance with claim 18, wherein in the "sofa" condition, the seat (40) assumes a position slightly tilted down and back.

20. SOFA-BED in accordance with claim 16, wherein the seat (40) comprises a metallic rectangular frame supporting a cloth deck (45) in its middle and front regions, the rear portion of said deck (45) being attached to the rear edge of the frame by means of a plurality of spring elements (46), the front and rear edges of seat (40) being interconnected by at least a lower curved stem (47) having its ends attached to said seat edges (40).

21. SOFA-BED in accordance with claim 16, wherein the layer of flexible material comprises two upholstery portions (80, 90) presenting a plurality of cross creases (81, 91) in the articulation regions between the to back portions (20, 30) and between the seat (40) and the footrest (50), the upholstery portions (80, 90) being arranged on the front portion of the back (30) and on the seat (40) so as to be displaced toward each other by a closing action of the cross creases (81, 91) when the sofa-bed is driven into the "bed" condition.

22. SOFA-BED in accordance with claim 16, wherein the end of the coupling of the stem (62) carries a pin (63) displaceable in a "C"-shaped groove (64) made on the plate (65), forward of the articulation axis between the back and the basic structure, the pin (63) being continuously urged by a spring element (66) to an end of the groove (64) lying above the articulation axis, the lever (61) being constantly urged upward by a return spring (67) attached to the basic structure (10).

23. SOFA-BED comprising a basic structure (10) defined by two lateral, parallel portions (11, 15) rearwardly interconnected to each other by means of a removably crossbeam (14); a back including a front portion (30) and a rear portion (20) articulated to each other by means of a pair of adjacent upper edges, the rear portion (20) having a lower extreme edge articulated to the structure (10); a seat (40) having a rear edge articulated to a lower extreme edge of the front back portion (30), and having a front edge articulated to an upper edge of a footrest (50), the seat (40) being supported on two pair of rollers (41, 42) so as to be horizontally displaceable between a "sofa" condition, with the rollers (41, 42) positioned between the lateral portions of the basic structure (10) and the front (30) and rear (20) portions of the back maintained in a raised position, and a "bed" condition, with the rollers displaced forward of the basic structure (10) and with the front and rear back portions and the footrest (50) arranged horizontally coplanar with the seat portion (40), being raised the footrest (50) into the horizontal position by a long, rigid stem (51) having a front end articulated to the footrest (50) and a rear end articulated to an extension (31) of the front portion of the back (30) that projects downwards from the articulation axis of that back portion with seat (40), said back portions, the seat and the footrest being lined with a layer of flexible material (80, 90), the rear portion of the back (20) including a flat plate (20a) having a front edge articulated near the upper edge of said rear portion of the back (20) to the back, that plate (20a) being stabilized in different tilt angles with respect to the rear portion when in the horizontal position by means of lateral stems (21a) that can be fitted into different points of lateral portions of the rear portion of the back (20).

* * * * *